US009719524B2

(12) United States Patent
Lin

(10) Patent No.: US 9,719,524 B2
(45) Date of Patent: Aug. 1, 2017

(54) CENTRIFUGAL FAN

(71) Applicant: Sunonwealth Electric Machine Industry Co., Ltd., Kaohsiung (TW)

(72) Inventor: Shih-Hang Lin, Kaohsiung (TW)

(73) Assignee: Sunonwealth Electric Machine Industry Co., Ltd., Kaohsiung (TW)

( * ) Notice: Subject to any disclaimer, the term of this patent is extended or adjusted under 35 U.S.C. 154(b) by 723 days.

(21) Appl. No.: 14/045,878

(22) Filed: Oct. 4, 2013

(65) Prior Publication Data

US 2014/0147261 A1 May 29, 2014

(30) Foreign Application Priority Data

Nov. 23, 2012 (TW) ..... 101143928 A

(51) Int. Cl.

| | |
|---|---|
| ***F04D 11/00*** | (2006.01) |
| ***F04D 29/42*** | (2006.01) |
| ***F04D 25/06*** | (2006.01) |
| ***F04D 29/44*** | (2006.01) |

(52) U.S. Cl.

CPC ..... *F04D 29/4226* (2013.01); *F04D 25/0613* (2013.01); *F04D 29/441* (2013.01)

(58) Field of Classification Search

CPC .. F05D 2260/96; F04D 29/663; F04D 29/668; F04D 29/522; F04D 29/665; F04D 29/4226; F04D 29/4213

USPC ..... 415/224, 206; 361/695

See application file for complete search history.

(56) References Cited

U.S. PATENT DOCUMENTS

| | | | | |
|---|---|---|---|---|
| 6,157,104 | A * | 12/2000 | Yokozawa | F04D 29/582 310/58 |
| 6,460,608 | B1 | 10/2002 | Katsui | |
| 6,585,485 | B2 | 7/2003 | Lee et al. | |
| 7,909,571 | B2 | 3/2011 | Wu et al. | |
| 8,251,642 | B2 | 8/2012 | Hwang et al. | |
| 2002/0167799 | A1 | 11/2002 | Kawashima et al. | |
| 2002/0176775 | A1* | 11/2002 | Lee | F04D 29/4213 415/206 |
| 2012/0070277 | A1 | 3/2012 | Chen et al. | |

FOREIGN PATENT DOCUMENTS

| | | |
|---|---|---|
| TW | M327055 U | 2/2008 |

* cited by examiner

*Primary Examiner* — Eric Keasel
*Assistant Examiner* — Jason Mikus
(74) *Attorney, Agent, or Firm* — Alan D. Kamrath; Kamrath IP Lawfirm, P.A.

(57) ABSTRACT

A centrifugal fan includes a fan frame, a stator assembly and an impeller. The fan frame has a base plate portion, a cover plate portion and a lateral wall portion. The cover plate portion includes first and second faces. The cover plate portion includes an air inlet, and the lateral wall portion includes an air outlet. The impeller has a radial rotational range. The cover plate portion includes an air-guiding section and an enlarged guiding section. The air-guiding section is aligned with the radial rotational range, and the enlarged guiding section is aligned with an area outside the radial rotational range. A part of the second face is spaced from a bottom of the base plate portion by a first minimal axial distance, and another part of the second face is spaced from the bottom by a second minimal axial distance smaller than the first minimal axial distance.

18 Claims, 8 Drawing Sheets

CENTRIFUGAL FAN

BACKGROUND OF THE INVENTION

1. Field of the Invention

The present invention generally relates to a cooling fan and, more particularly, to a centrifugal cooling fan.

2. Description of the Related Art

Conventional cooling fans include axial-flow fans and centrifugal fans. The axial-flow fan has an axial air inlet and an axial air outlet opposite to the axial air inlet. Air can be drawn into the fan via the axial air inlet and then expelled from the fan via the axial air outlet. The centrifugal fan has an axial air inlet in an axial direction and a radial air outlet in a radial direction of the fan. Air can be drawn into the fan via the axial air inlet and then expelled from the fan via the radial air outlet for cooling purposes.

Since the axial-flow fan expels air only in the axial direction rather than in the radial direction, the axial-flow fan must be mounted on the top of an electronic device to be cooled, such as a Central Processing Unit (CPU) of a computer. As a result, the height of the electronic device cannot be reduced.

In addition, since the centrifugal fan is able to expel air via the radial air outlet, it is not required to mount the centrifugal fan on the top of the heat source. Advantageously, it allows the centrifugal fan to be installed in various electronic devices with limited interior spaces (such as mobile phones, notebook computers, PDAs, etc). However, when the centrifugal fan is installed in the electronic device, foreign debris (such as dust or water) may enter the centrifugal fan via its axial air inlet, resulting in damage to the fan.

In light of this problem, Taiwan Patent No. I330224 discloses a centrifugal fan 9 as shown in FIG. 1. The centrifugal fan 9 includes a fan frame 91 having an axial air inlet 911 and a radial air outlet 912. The fan frame 91 receives an impeller and a stator assembly that is used to drive the impeller to rotate.

The centrifugal fan 9 may be installed in an electronic device 90 having a frame 901 and a partitioning wall 902. A lateral air passage "S" may be formed between the fan frame 91 and the partitioning wall 902. When the stator assembly drives the impeller to rotate, air can be drawn into the lateral air passage "S" via an air inlet of the frame 901. In the electronic device 90, air is drawn into the centrifugal fan 9 via the axial air inlet 911 and expelled from the fan 9 via the radial air outlet 912. Based on this, the fan 9 is able to output air currents to the heat source for cooling purposes.

Since the lateral air passage "S" is provided for air to smoothly flow into the fan 9 via the axial air inlet 911, the impeller of the fan 9 will not be able to guide sufficient air into the fan 9 via the lateral air passage "S" if the space between the fan frame 91 and the partitioning wall 902 is insufficient. As a result, the amount of air flowing into the fan 9 will be limited, affecting the cooling effect of the fan 9. The service life of the electronic device 90 is even shortened.

SUMMARY OF THE INVENTION

It is therefore the objective of this invention to provide a centrifugal fan that is designed with sufficient intake air capacity.

In a preferred embodiment, a centrifugal fan comprising a fan frame, a stator assembly and an impeller is disclosed. The fan frame has a base plate portion and a cover plate portion. A lateral wall portion is arranged between the base plate portion and the cover plate portion. The cover plate portion comprises a first face and a second face opposite to the first face. The first face faces the base plate portion. The cover plate portion further comprises an air inlet extending from the first face to the second face, and the lateral wall portion comprises an air outlet. The stator assembly is received in the fan frame. The impeller is rotatably coupled with the stator assembly between the base plate portion and the cover plate portion. The impeller has a radial rotational range. The cover plate portion of the fan frame further comprises an air-guiding section and an enlarged guiding section. The air-guiding section is aligned with the radial rotational range of the impeller, and the enlarged guiding section is aligned with an area outside the radial rotational range of the impeller. A part of the second face that is located within the air-guiding section is spaced from a bottom of the base plate portion by a first minimal axial distance, and another part of the second face that is located within the enlarged guiding section is spaced from the bottom of the base plate portion by a second minimal axial distance. The second minimal axial distance is smaller than the first minimal axial distance.

In a preferred form shown, the cover plate portion of the fan frame has an air-out edge and an outer edge opposing to the air-out edge. The air outlet of the fan frame is formed between the air-out edge and the base plate portion, and the outer edge is provided with an enlarged portion which forms the enlarged guiding section.

In the preferred form shown, the cover plate portion of the fan frame has an air-out edge and an outer edge opposing to the air-out edge. The air outlet of the fan frame is formed between the air-out edge and the base plate portion. The cover plate portion of the fan frame further comprises a first edge and a second edge opposing to the first edge. The first and second edges are connected between the air-out edge and the outer edge. One or both of the first and second edges has an enlarged portion forming the enlarged guiding section.

In the preferred form shown, the enlarged portion is of a truncated face formed by truncating the cover plate portion on a corner where the second face and the outer edge intersect each other, and the truncated face extends outwards in a radial direction while extending slightly downwards in an axial direction of the fan frame. Alternatively, the enlarged portion is of an inclined face which extends outwards in a radial direction while extending slightly downwards in an axial direction of the fan frame. Alternatively, the enlarged portion is of a bent face which extends outwards in a radial direction and is bent downwards. Alternatively, the enlarged portion is of an arcuate face.

In the preferred form shown, the centrifugal fan further comprises a partitioning member connected to the fan frame and facing the air inlet. An air-guiding space is formed between the partitioning member and the air-guiding section of the cover plate portion. An expanded lateral air-guiding opening is formed between the partitioning member and the enlarged guiding section of the cover plate portion. The expanded lateral air-guiding opening gradually expands from the air-guiding section to an outer edge of the cover plate portion.

In the preferred form shown, the centrifugal fan further comprises a plurality of coupling members arranged around the air inlet of the cover plate portion. The coupling members are spaced from each other. The partitioning member has a plurality of through-holes corresponding to the plurality of coupling members. A plurality of fixing members is extended through the through-holes to fix the partitioning member in a position.

In the preferred form shown, the centrifugal fan further comprises two opposing barriers arranged around the air inlet of the fan frame, and the partitioning member is positioned on the two barriers.

In the preferred form shown, the centrifugal fan further comprises a surrounding wall arranged around the air inlet of the fan frame. The surrounding wall has an opening, and the partitioning member is positioned on the surrounding wall.

BRIEF DESCRIPTION OF THE DRAWINGS

The present invention will become more fully understood from the detailed description given hereinafter and the accompanying drawings which are given by way of illustration only, and thus are not limitative of the present invention, and wherein.

Figure 1:
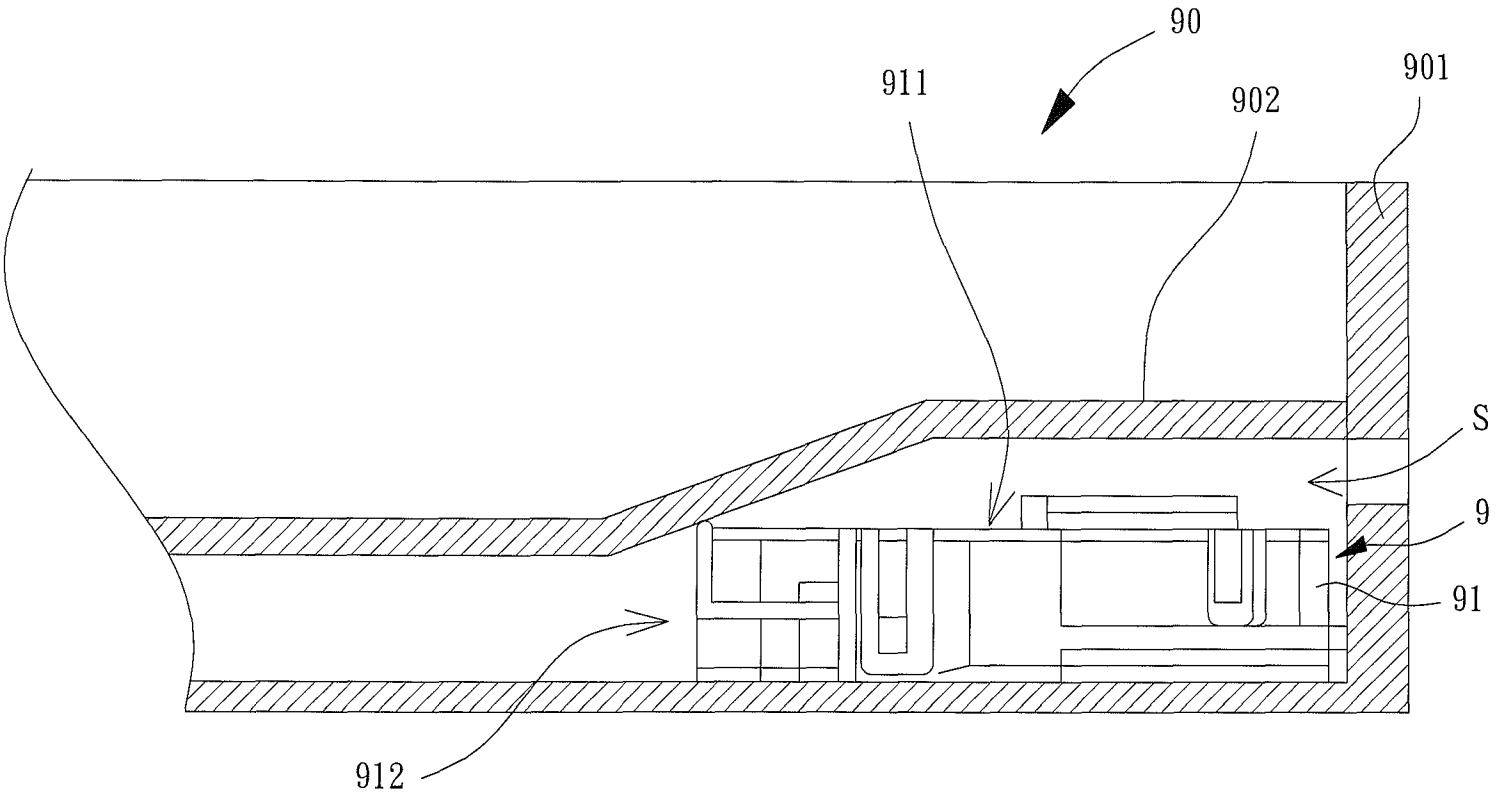
FIG. 1 PRIOR ART
FIG. 1 is a cross-sectional view of a conventional centrifugal fan.

In the various figures of the drawings, the same numerals designate the same or similar parts. Furthermore, when the terms "first", "second", "third", "fourth", "inner", "outer", "top", "bottom", "front", "rear" and similar terms are used hereinafter, it should be understood that these terms have reference only to the structure shown in the drawings as it would appear to a person viewing the drawings, and are utilized only to facilitate describing the invention.

DETAILED DESCRIPTION OF THE INVENTION

Figure 2:
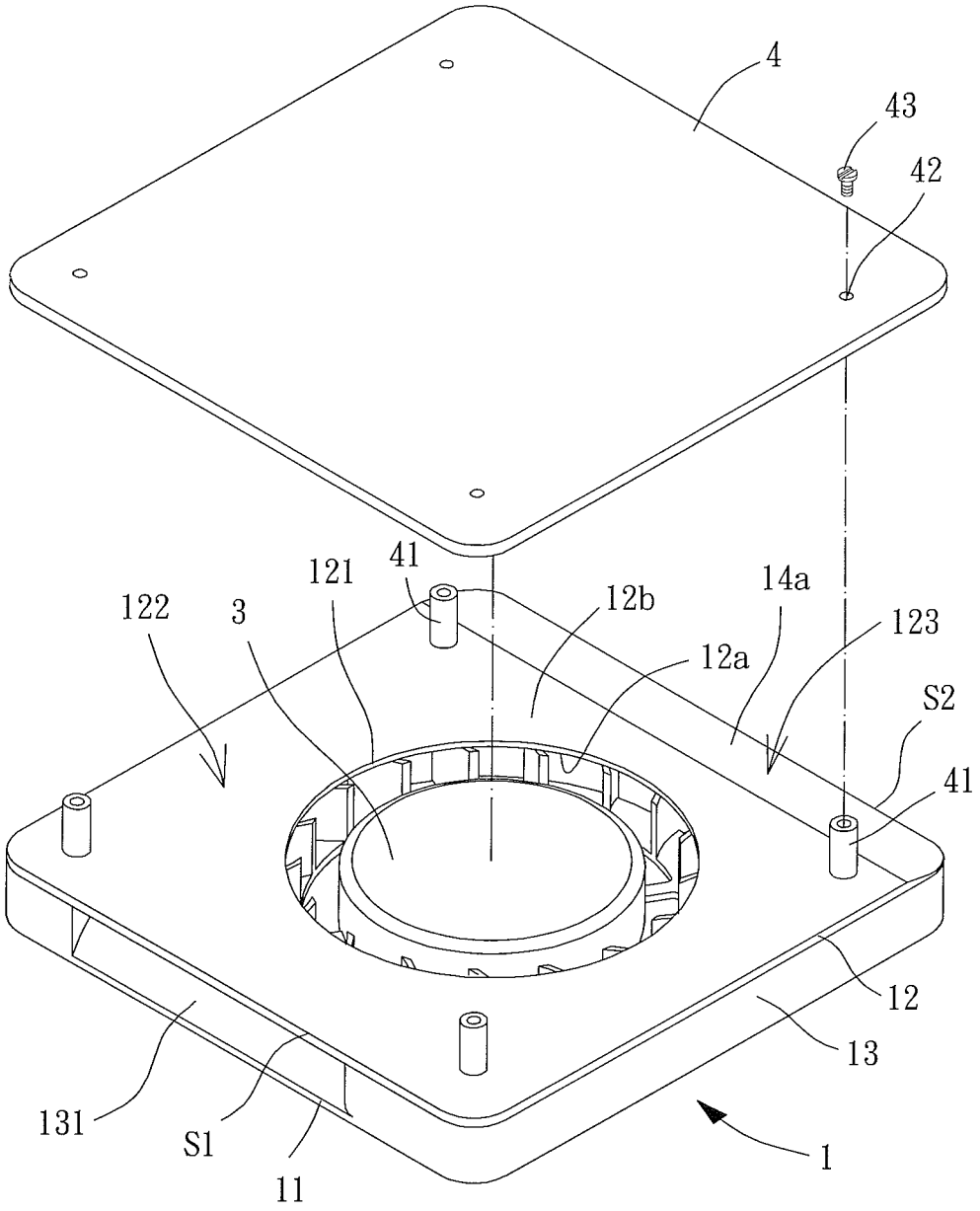
FIG. 2 is an exploded view of a centrifugal fan according to a first embodiment of the invention.
Figure 3:
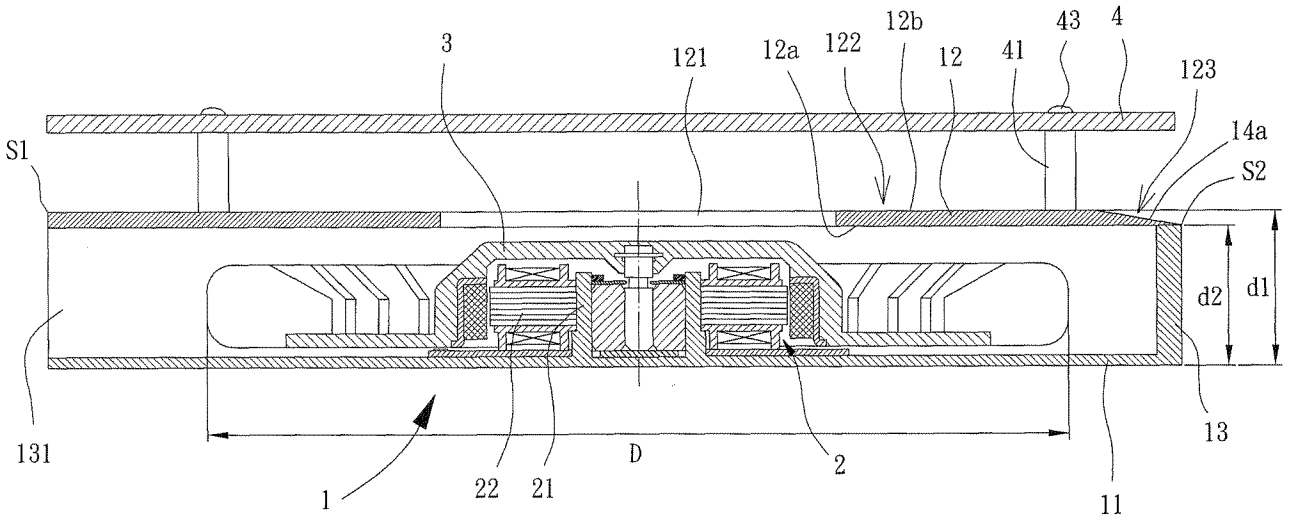
FIG. 3 is a cross-sectional view of the centrifugal fan shown in FIG. 2.

FIGS. 2 and 3 show a centrifugal fan including a fan frame 1, a stator assembly 2 and an impeller 3 according to a preferred embodiment of the invention. The fan frame 1 is of any structure that air can flow into and out of it. The stator assembly 2 is received in the fan frame 1. The impeller 3 is rotatably coupled with the stator assembly 2 so that the stator assembly 2 is able to drive the impeller 3 to rotate.

The fan frame 1 is of any hollow frame structure capable of receiving the stator assembly 2 and the impeller 3. Air can flow into the frame structure in an axial direction and flow out of the frame structure in a radial direction. The frame structure may have various geometric shapes, such as a polygonal shape, a round shape, an oval shape, etc. In this embodiment, the fan frame 1 has a rectangular shape.

The fan frame 1 includes a base plate portion 11 and a cover plate portion 12 spaced from the base plate portion 11 by a distance. The distance allows a lateral wall portion 13 to be arranged between the base plate portion 11 and the cover plate portion 12. The base plate portion 11, the cover plate portion 12 and the lateral wall portion 13 can be coupled with each other in any manner without limitations. In this embodiment, the lateral wall portion 13 is integrally formed on an outer periphery of the base plate portion 11 in injection molding. The cover plate portion 12 is in the form of a cover plate that can be affixed to and detached from the lateral wall portion 13.

The cover plate portion 12 of the fan frame 1 includes an air inlet 121. As shown in FIG. 3, the cover plate portion 12 further includes a first face 12*a* facing an interior of the fan frame 1 (i.e. facing the base plate portion 11), as well as a second face 12*b* facing away from the interior of the fan frame 1. The air inlet 121 extends from the first face 12*a* to the second face 12*b*. The lateral wall portion 13 includes an air outlet 131. In this arrangement, a fan frame of a centrifugal fan is formed. Based on different requirements, the fan frame 1 may include more than one air inlet 121 and air outlet 131, and their locations can be changed as desired.

The cover plate portion 12 of the fan frame 1 further includes an air-guiding section 122 and an enlarged guiding section 123. Referring to FIG. 3, the part of the second face 12*b* that is located within the air-guiding section 122 is spaced from a bottom of the base plate portion 11 by a first minimal axial distance d1, whereas the part of the second face 12*b* that is located within the enlarged guiding section 123 is spaced from the bottom of the base plate portion 11 by a second minimal axial distance d2. The second minimal axial distance d2 is smaller than the first minimal axial distance d1.

The stator assembly 2 is installed between the base plate portion 11 and the cover plate portion 12 in the fan frame 1. The stator assembly 2 can be of any structure capable of driving the impeller 3 to rotate when coupled with impeller 3. Referring to FIG. 3, the stator assembly 2 includes a shaft seat 21 and a coil unit 22. The shaft seat 21 can be affixed to or integrally formed on the base plate portion 11 of the fan frame 1. The coil unit 22 (which may include components such as a plurality of silicon steel plates, a coil, an insulation bobbin, etc,) surrounds the shaft seat 21 and is electrically connected to a driving circuit (not shown), driving the impeller 3 to rotate.

The impeller 3 is rotatably coupled with the stator assembly 2 and installed in the fan frame 1. In this embodiment, the impeller 3 is rotatably coupled with the shaft seat 21 of the stator assembly 2. The impeller 3 has a radial rotational range D within which the impeller 3 rotates. The air-guiding section 122 is aligned with the radial rotational range "D," and the enlarged guiding section 123 is axially aligned with the area outside the radial rotational range "D."

Figure 4:
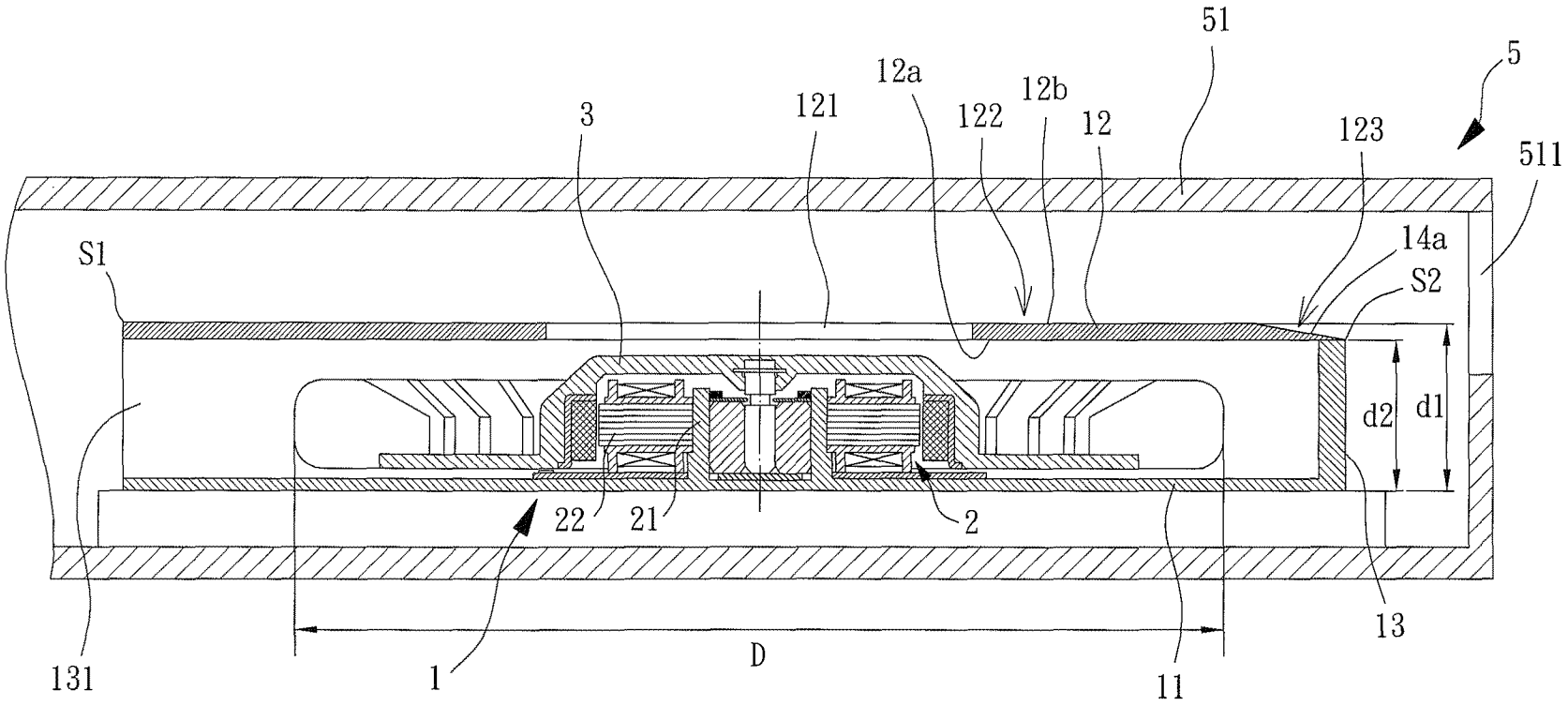
FIG. 4 is a cross-sectional view of an electronic device having the centrifugal fan in the first embodiment of the invention, with the centrifugal fan not having a partitioning member shown in FIGS. 2 and 3.

FIG. 4 shows a use of the centrifugal fan in which a partitioning member 4 shown in FIGS. 2 and 3 is omitted (which will be described in detail later). In the use of the centrifugal fan, the centrifugal fan is installed in an electronic device 5 (such as mobile phones, PDAs, notebook computers, etc) that is designed with a lateral air inlet to allow air to flow into the electronic device 5 via the lateral air inlet. In this regard, the cover plate portion 12 of the fan frame 1 is spaced from an inner wall of a housing 51 of the electronic device 5 by a distance. An air-guiding space is formed between the inner wall of the housing 51 and the air-guiding section 122 of the fan frame 1. At least one expanded lateral air-guiding opening is formed between the inner wall of the housing 51 and the enlarged guiding section 123 of the fan frame 1. The expanded lateral air-guiding opening gradually expands from the air-guiding section 122 to an outer edge of the cover plate portion 12 in an axial direction of the centrifugal fan. The expanded lateral air-guiding opening is aligned with an air inlet 511 of the housing 51 in a radial direction of the centrifugal fan. In this arrangement, the impeller 3 may be driven to rotate when the alternating magnetic fields generated by the coil unit 22 of the stator assembly 2 drives a permanent magnet of the impeller 3 to rotate. The principle on how the stator assembly 2 drives the impeller 3 to rotate, as well as the detailed structures of the stator assembly 2 and the impeller 3, are not described herein, as it can be readily appreciated by one having ordinary skill in the art.

During the rotation of the impeller 3, a large amount of air can be guided into the housing 51 via the air inlet 511, and then guided into the air-guiding space via the expanded lateral air-guiding opening. Finally, the air in the air-guiding space is guided into the fan frame 1 via the air inlet 121. The air in the fan frame 1 is guided to a predetermined heat source via the air outlet 131 for cooling purposes. In this regards, the centrifugal fan may be installed in different electronic devices to provide a cooling effect for the heat sources of the electronic devices. The amount of air flowing into the centrifugal fan may be increased based on the expansion of the expanded lateral air-guiding opening, achieving an improved air-guiding effect. As a result, the cooling effect of the centrifugal fan is improved, prolonging the service life of the electronic device 5.

The centrifugal fan in the invention preferably includes a partitioning member 4. The partitioning member 4 is connected to the fan frame 1 and faces the air inlet 121. Referring to FIG. 3, the air-guiding space is formed between the partitioning member 4 and the air-guiding section 122 of the fan frame 1, and the expanded lateral air-guiding opening is formed between the partitioning member 4 and the enlarged guiding section 123 of the fan frame 1. Thus, since the partitioning member 4 and the cover plate portion 12 automatically form the air-guiding space and the expanded lateral air-guiding opening when the centrifugal fan is installed in the electronic device 5, it can be ensured that the centrifugal fan still has a lateral opening with an expanded pattern without having to form such a lateral opening using the housing 51 of the electronic device 5 as shown in FIG. 4. Therefore, the installation and use of the centrifugal fan is not limited by the interior structure of the housing 51 of the electronic device 5, improving the convenience in installation of the centrifugal fan.

Moreover, the air-guiding section 122, the enlarged guiding section 123 and the partitioning member 4 of the fan frame 1 may have various implementations, as described below.

Referring to FIGS. 2 and 3, the cover plate portion 12 of the fan frame 1 may have an air-out edge S1 and an outer edge S2 opposing to the air-out edge S1. The air outlet 131 of the fan frame 1 is formed between the air-out edge S1 and the base plate portion 11. The outer edge S2 is provided with an enlarged portion 14*a* which forms the enlarged guiding section 123. In the embodiment, the enlarged portion 14*a* is a truncated face formed by truncating the cover plate portion 12 on the corner where the second face 12*b* and the outer edge S2 intersect each other. The truncated face extends outwards in the radial direction while extending slightly downwards in the axial direction. Specifically, the truncated face extends from the air-guiding section 122 to the outer edge S2 of the cover plate portion 12 in the radial direction while extending slightly downwards towards the base plate portion 11 in the axial direction. In addition, a plurality of coupling members 41 may be arranged around the air inlet 121 of the cover plate portion 12, with the coupling members 41 spaced from each other. The partitioning member 4 has a plurality of through-holes 42 corresponding to the plurality of coupling members 41. The through-holes 42 have the same quantity as the coupling members 41. Based on this, a plurality of fixing members 43 (such as screws) may be extended through the through-holes 42 and fixed to the coupling members 41, fixing the partitioning member 4 in a position over the air inlet 121 of the cover plate portion 12 to ensure a sufficient space between the partitioning member 4 and the cover plate portion 12.

Referring to FIGS. 2 and 3, since the enlarged guiding section 123 may be spaced from the air outlet 131 at a relatively larger distance, it can prevent the incoming air that is guided into the air-guiding space through the enlarged guiding section 123 from interfering with the outgoing air expelled through the air outlet 131. Thus, an improved cooling effect is achieved.

Figure 5:
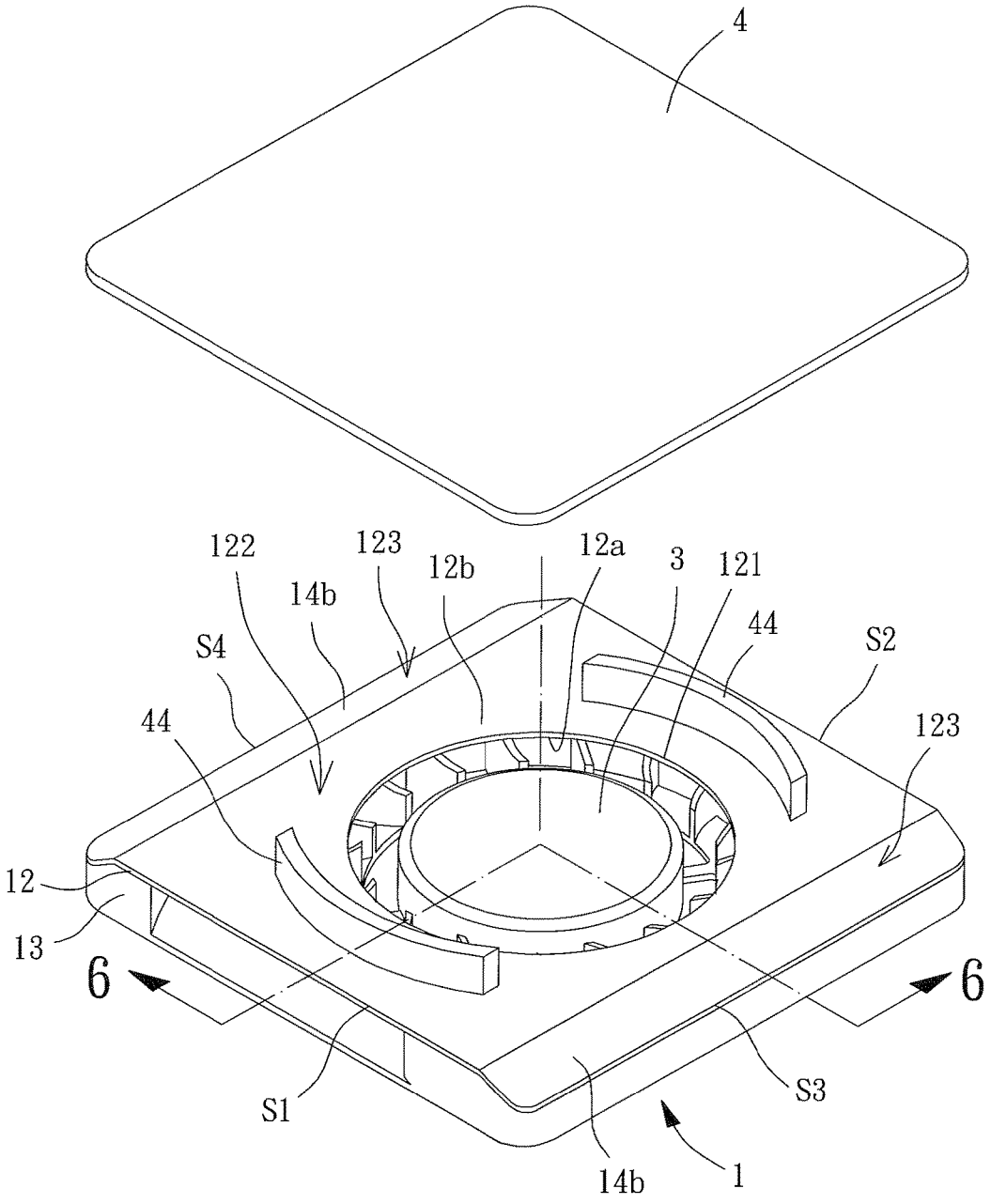
FIG. 5 is an exploded view of a centrifugal fan according to a second embodiment of the invention.
Figure 6:
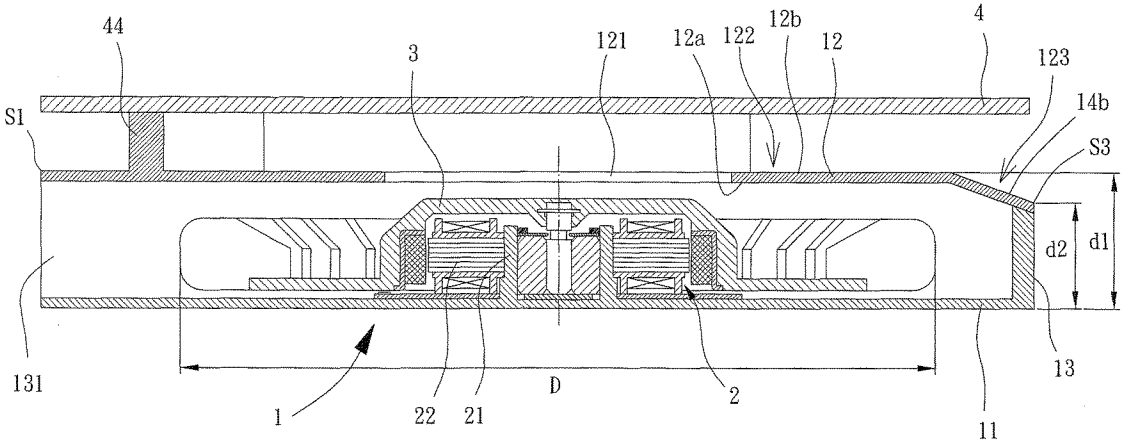
FIG. 6 is a cross-sectional view of the centrifugal fan shown in FIG. 5.

Referring to FIGS. 5 and 6, the cover plate portion 12 of the fan frame 1 has an air-out edge S1 and an outer edge S2 opposing to the air-out edge S1. The air outlet 131 is formed between the air-out edge S1 and the base plate portion 11 of the fan frame 1. The outer edge S2 is the edge of the cover plate portion 12 relatively distant to the air-out edge S1. The cover plate portion 12 of the fan frame 1 further includes a first edge S3 and a second edge S4 opposing to the first edge S3. The first edge S3 and the second edge S4 are connected between the air-out edge S1 and the outer edge S2. One or both of the first edge S3 and the second edge S4 may have an enlarged portion 14*b*. In a preferred case, both the first edge S3 and the second edge S4 are provided with the enlarged portion 14*b*, with each enlarged portion 14*b* forming an enlarged guiding section 123. In this embodiment, the two enlarged portions 14*b* are in the form of two inclined faces respectively formed on the first edge S3 and the second edge S4 of the cover plate portion 12. Both inclined faces gradually extend outwards in the radial direction while extending slightly downwards in the axial direction. Specifically, one inclined face extends from the air-guiding section 122 to the first edge S3 of the cover plate portion 12 in the radial direction while extending slightly downwards towards the base plate portion 11 in the axial direction. Also, the other inclined face extends from the air-guiding section 122 to the second edge S4 of the cover plate portion 12 in the radial direction while extending slightly downwards towards the base plate portion 11 in the axial direction. Furthermore, two opposing barriers 44 may be arranged around the air inlet 121 of the fan frame 1. One barrier 44 is arranged between and aligned with the air-out edge S1 of the cover plate portion 12 and the air inlet 121 in the radial direction, whereas the other barrier 44 is arranged between and aligned with the outer edge S2 of the cover plate portion 12 and the air inlet 121 in the radial direction. The partitioning member 4 may be positioned on the two barriers 44 and over the air inlet 121 of the cover plate portion 12 to ensure a sufficient space between the partitioning member 4 and the cover plate portion 12.

As the example shown in FIGS. 5 and 6, the two enlarged guiding sections 123 formed by the two enlarged portions 14*b* (inclined faces) are able to guide a relatively larger amount of air towards the air inlet 121 of the cover plate portion 12 as compared to the enlarged guiding section 123 shown in FIGS. 2 and 3. Furthermore, since the two enlarged guiding sections 123 are arranged on two opposing edges of the cover plate portion 12 (namely, the first edge S3 and the second edge S4), the centrifugal fan is able to guide air into the centrifugal fan in two directions. As such, the intake air capacity can be doubled to achieve an improved cooling effect. Moreover, the barrier 44 between the air-out edge S1 of the cover plate portion 12 and the air inlet 121 may separate the air inlet 121 and the air outlet 131 of the centrifugal fan from each other, efficiently preventing the incoming air that is guided through the two enlarged guiding sections 123 from interfering with the outgoing air expelled through the air outlet 131.

Figure 7:
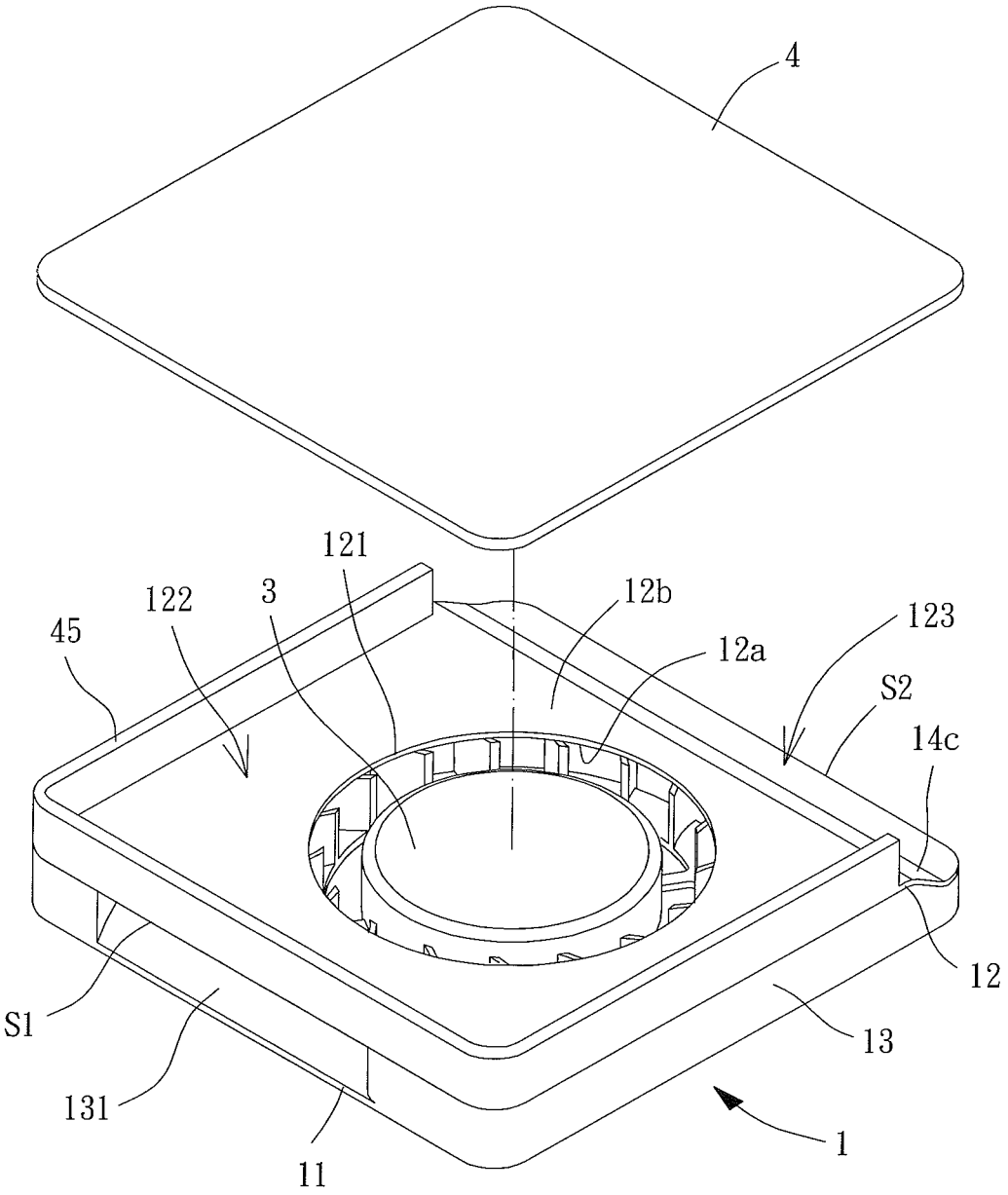
FIG. 7 is an exploded view of a centrifugal fan according to a third embodiment of the invention.
Figure 8:
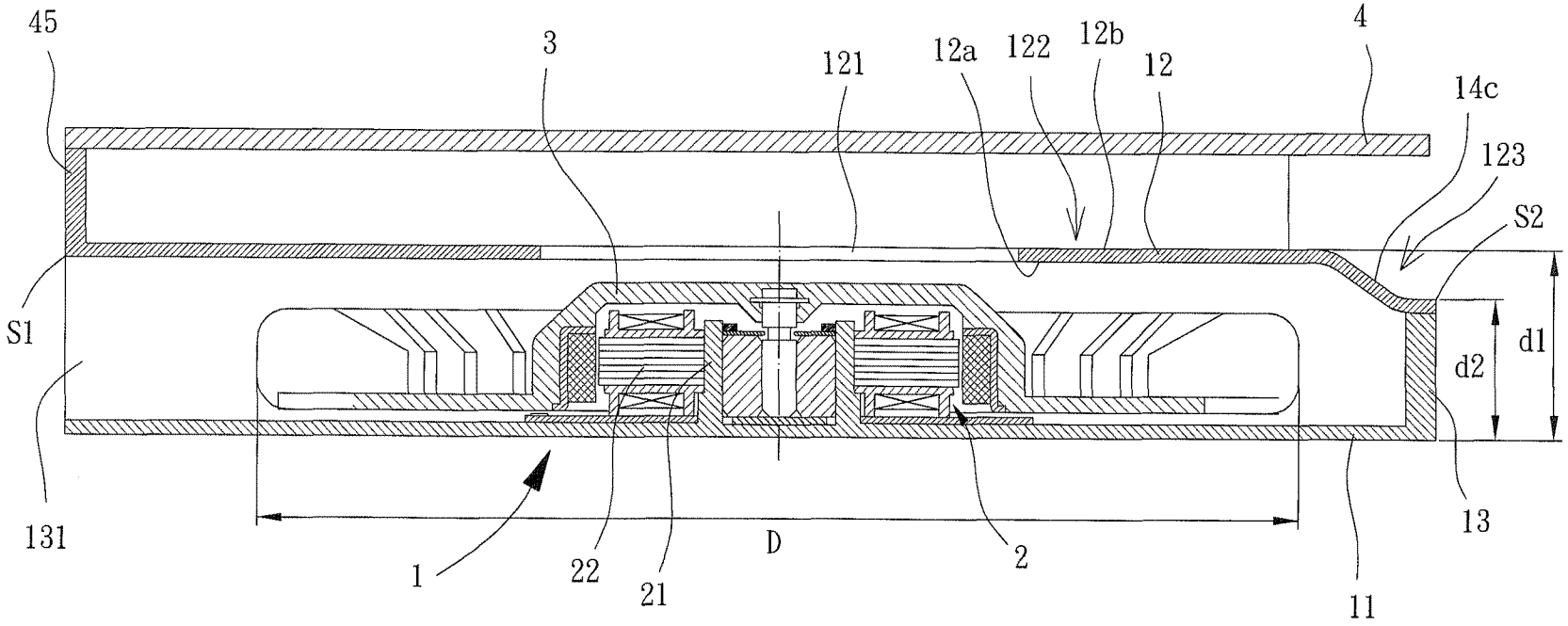
FIG. 8 is a cross-sectional view of the centrifugal fan shown in FIG. 7.

Referring to FIGS. 7 and 8, the cover plate portion 12 of the fan frame 1 has an air-out edge S1 and an outer edge S2 opposing to the air-out edge S1. The cover plate portion 12 includes an enlarged portion 14*c* on the outer edge S2, with the enlarged portion 14*c* forming an enlarged guiding section 123. In this embodiment, the enlarged portion 14*c* is a bent face formed on the outer edge S2 of the cover plate portion 12. The bent face gradually extends outwards in the radial direction and is bent downwards. Specifically, the bent face extends from the air-guiding section 122 to the outer edge S2 of the cover plate portion 12 in the radial direction when bent downwards towards the base plate portion 11. Furthermore, a surrounding wall 45 having an opening may be arranged around the air inlet 121 of the fan frame 1 to allow air to be drawn into the centrifugal fan via the opening in the radial direction. The partitioning member 4 may be positioned on the surrounding wall 45 and over the air inlet 121 of the cover plate portion 12 to ensure a sufficient space between the partitioning member 4 and the cover plate portion 12.

Referring to FIGS. 7 and 8, the enlarged guiding section 123 formed by the enlarged portion 14*c* (bent face) is able to guide a relatively larger amount of air towards the air inlet 121 of the cover plate portion 12 as compared to the enlarged guiding sections 123 shown in FIGS. 2, 3, 5 and 6. As such, the amount of air that is drawn into the centrifugal fan in the radial direction can be increased. Moreover, the surrounding wall 45 may be arranged between the air-out edge S1 of the cover plate portion 12 and the air inlet 121. Therefore, the air inlet 121 and the air outlet 131 of the centrifugal fan can be separated from each other to efficiently prevent the incoming air that is guided through the enlarged guiding section 123 from interfering with the outgoing air expelled through the air outlet 131.

In addition, the locations and quantities of the enlarged portions 14*a*, 14*b* and 14*c* may be changed based on requirement. Specifically, each of the outer edge S2, the first edge S3 and the second edge S4 may be provided with either one of the enlarged portions 14*a*, 14*b* and 14*c*. In the embodiment, although the enlarged portions 14*a*, 14*b* and 14*c* are implemented as the truncated face, the inclined face and the bent face, other implementations that achieve the same function are also possible. For instance, each of the enlarged portions 14*a*, 14*b* and 14*c* may also be in the form of an arcuate face, as it can be readily appreciated by one having ordinary skill in the art.

In conclusion, when the centrifugal fan is installed in an electronic device, the intake air capacity of the centrifugal fan can be efficiently increased under the arrangement of the enlarged guiding section 123 formed by the cover plate portion 12. Thus, improved cooling effect is provided, and the service life of the electronic device is prolonged.

Although the invention has been described in detail with reference to its presently preferable embodiments, it will be understood by one of ordinary skill in the art that various modifications can be made without departing from the spirit and the scope of the invention, as set forth in the appended claims.

What is claimed is:

1. A centrifugal fan comprising:

a fan frame having a base plate portion and a cover plate portion, wherein a lateral wall portion is arranged between the base plate portion and the cover plate portion, wherein the cover plate portion comprises a first face and a second face opposite to the first face, wherein the first face faces and is spaced from the base plate portion, wherein the lateral wall portion includes an inside face extending between the first face and the base plate portion, wherein an interior is defined between the first face and the base plate portion and by the inside face of the lateral wall portion, wherein the cover plate portion further comprises an air inlet extending from the first face to the second face, and wherein the lateral wall portion comprises an air outlet;

a stator assembly received in the fan frame; and an impeller rotatably coupled with the stator assembly between the base plate portion and the cover plate portion, wherein the impeller has a radial rotational range;

wherein the cover plate portion of the fan frame further comprises an air-guiding section and an enlarged guiding section, wherein the air-guiding section is aligned with the radial rotational range of the impeller, wherein a portion of the first face of the cover plate portion corresponding to the enlarged guiding section in the interior is aligned with an area outside the radial rotational range of the impeller, radially within the inside face of the lateral wall portion and spaced from the base plate portion, wherein a part of the second face that is located within the air-guiding section is spaced from a bottom of the base plate portion by a first minimal axial distance, wherein another part of the second face that is located within the enlarged guiding section and the lateral wall is spaced from the bottom of the base plate portion by a second minimal axial distance, and wherein the second minimal axial distance is smaller than the first minimal axial distance.

2. The centrifugal fan as claimed in claim 1, wherein the cover plate portion of the fan frame has an air-out edge and an outer edge opposing to the air-out edge, wherein the air outlet of the fan frame is formed between the air-out edge and the base plate portion, and wherein the outer edge is provided with an enlarged portion which forms the enlarged guiding section.

3. The centrifugal fan as claimed in claim 1, wherein the cover plate portion of the fan frame has an air-out edge and an outer edge opposing to the air-out edge, wherein the air outlet of the fan frame is formed between the air-out edge and the base plate portion, wherein the cover plate portion of the fan frame further comprises a first edge and a second edge opposing to the first edge, wherein the first and second edges are connected between the air-out edge and the outer edge, and wherein one of the first and second edges has an enlarged portion forming the enlarged guiding section.

4. The centrifugal fan as claimed in claim 1, wherein the cover plate portion of the fan frame has an air-out edge and an outer edge opposing to the air-out edge, wherein the air outlet of the fan frame is formed between the air-out edge and the base plate portion, wherein the cover plate portion of the fan frame further comprises a first edge and a second edge opposing to the first edge, wherein the first and second edges are connected between the air-out edge and the outer edge, and wherein both the first and second edges have an enlarged portion forming the enlarged guiding section.

5. The centrifugal fan as claimed in claim 2, wherein the enlarged portion is of a truncated face formed by truncating the cover plate portion on a corner where the second face and the outer edge intersect each other.

6. The centrifugal fan as claimed in claim 5, wherein the truncated face extends outwards in a radial direction while extending slightly downwards in an axial direction of the fan frame.

7. The centrifugal fan as claimed in claim 2, wherein the enlarged portion is of an inclined face.

8. The centrifugal fan as claimed in claim 7, wherein the inclined face extends outwards in a radial direction while extending slightly downwards in an axial direction of the fan frame.

9. The centrifugal fan as claimed in claim 2, wherein the enlarged portion is of a bent face.

10. The centrifugal fan as claimed in claim 9, wherein the bent face extends outwards in a radial direction and is bent downwards.

11. The centrifugal fan as claimed in claim 2, wherein the enlarged portion is of an arcuate face.

12. The centrifugal fan as claimed in claim 1, further comprising a partitioning member connected to the fan frame and facing the air inlet, wherein an air-guiding space is formed between the partitioning member and the air-guiding section of the cover plate portion, wherein an expanded lateral air-guiding opening is formed between the partitioning member and the enlarged guiding section of the cover plate portion, and wherein the expanded lateral air-guiding opening has gradually expanded from the air-guiding section to an outer edge of the cover plate portion in an axial direction of the fan frame.

13. The centrifugal fan as claimed in claim 12, further comprising a plurality of coupling members arranged around the air inlet of the cover plate portion, wherein the coupling members are spaced from each other, wherein the partitioning member has a plurality of through-holes corresponding to the plurality of coupling members, and wherein a plurality of fixing members is extended through the through-holes to fix the partitioning member in a position.

14. The centrifugal fan as claimed in claim 12, further comprising two opposing barriers arranged around the air inlet of the fan frame, wherein the partitioning member is positioned on the two barriers.

15. The centrifugal fan as claimed in claim 12, further comprising a surrounding wall arranged around the air inlet of the fan frame, wherein the surrounding wall has an opening, and wherein the partitioning member is positioned on the surrounding wall.

16. The centrifugal fan as claimed in claim 1, wherein the lateral wall portion extends only axially between the base plate portion and the first face of the cover plate portion.

17. The centrifugal fan as claimed in claim 16, wherein the first and second faces of the cover plate portion have a constant spacing within the lateral wall portion.

18. The centrifugal fan as claimed in claim 1, wherein the first and second faces of the cover plate portion have a constant spacing within the lateral wall portion.

* * * * *